US009062937B1

(12) United States Patent
Brown et al.

(10) Patent No.: US 9,062,937 B1
(45) **Date of Patent: *Jun. 23, 2015**

(54) BALLISTIC VEST

(71) Applicant: Safariland, LLC, Jacksonville, FL (US)

(72) Inventors: Blake B. Brown, Jacksonville, FL (US); Steven H. Yeh, Hastings, FL (US); Mark Cardey, Jacksonville, FL (US); David Pittman, Temecula, CA (US); Patricia C. Tilman, Fernandina Beach, FL (US); Ginny S. Mixon, Fernandina Beach, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/288,953

(22) Filed: May 28, 2014

Related U.S. Application Data

(63) Continuation of application No. 13/744,499, filed on Jan. 18, 2013, now Pat. No. 8,739,312.

(51) Int. Cl.
*F41H 1/02* (2006.01)

(52) U.S. Cl.
CPC ..... *F41H 1/02* (2013.01)

(58) Field of Classification Search
CPC ..... F41H 1/02
USPC ..... 2/463, 2.5, 92, 97, 102; 89/36.02, 89/36.05; 428/911
See application file for complete search history.

(56) References Cited

U.S. PATENT DOCUMENTS

| | | | | |
|---|---|---|---|---|
| 4,413,357 | A * | 11/1983 | Sacks | 2/2.5 |
| 4,696,066 | A * | 9/1987 | Ball et al. | 2/272 |
| 5,431,318 | A * | 7/1995 | Garcia | 224/192 |
| 5,918,309 | A * | 7/1999 | Bachner, Jr. | 2/2.5 |
| 6,704,934 | B2 * | 3/2004 | Graham et al. | 2/2.5 |
| 8,528,112 | B2 * | 9/2013 | Blauer et al. | 2/2.5 |
| 8,739,312 | B1 * | 6/2014 | Brown et al. | 2/2.5 |

* cited by examiner

*Primary Examiner* — Tejash Patel
(74) *Attorney, Agent, or Firm* — Kane Kessler, P.C.; Paul E. Szabo

(57) ABSTRACT

A ballistic vest does not include or require a carrier. The vest includes a front ballistic panel permanently enclosed in a front waterproof cover, the front waterproof cover having, on its outer surface, portions of an adjustable body-attachment system; a front body side liner that is detachably secured to a body side portion of the front waterproof cover and that is machine washable; a back ballistic panel permanently enclosed in a back waterproof cover, the back waterproof cover having, on its outer surface, portions of an adjustable body-attachment system; and a back body side liner that is detachably secured to a body side portion of the back waterproof cover and that is machine washable.

9 Claims, 6 Drawing Sheets

BALLISTIC VEST

BACKGROUND OF THE INVENTION

This invention relates to a ballistic vest, for example of the type worn by a police officer. Such vests are typically worn for an extended period of time, which can be an entire shift of eight hours or more. It is desirable that a vest be as light weight as possible, for comfort. It is also desirable that a vest be as "cool" as possible for the wearer.

Ballistic vests of this type typically include a carrier. One example is shown in U.S. Pat. No. 5,431,318, the entire disclosure of which is hereby incorporated by reference. The carrier serves to support and enclose the ballistic panels, and to provide locations to which the body securing straps can be attached.

A ballistic vest needs to be "waterproof" at least to some extent. That is, the vest needs to retain its ballistic capabilities if it gets wet or is soaked as when the vest is submerged in water while being worn. One recent standard on water resistance has been promulgated by the National Institutes of Justice in its NIJ Standard-0101.06, for ballistic vests. The relevant portion of the standard reads as follows.

4.2.4 Armor Submersion Equipment

The armor submersion equipment shall consist of a water bath sufficiently sized to allow at least one armor panel of the largest template size defined in appendix C to hang vertically, without any folds or bends, with the top edge of the armor at least 100 mm (3.9 in) below the surface of the water, and with at least 50 mm (2.0 in) clearance around the panel.

The water in the bath shall be clean and shall be either potable tap or demineralized water. The water shall be replaced anytime there are visible impurities in the water. The water temperature shall be 21° C.+2.9° C./−5.8° C. (70° F.+5° F./−10° F).

7.8.2 Armor Submersion

New Flexible Vests and Jackets: All new flexible vests and jackets shall be submersed and tested wet. Each armor panel shall be hung vertically in a water bath meeting the requirements of section 4.2.4 for 30 min (+5 min/−0 min) with the top edge of the armor positioned 100 mm±25 mm (3.9 in±1.0 in) below the water surface. For armors that are buoyant, weights shall be attached to the bottom edge of the armor with clothes pins or similar clips to allow the armor to hang vertically. After removing the panel from the water, it shall be hung vertically and allowed to dry for 10 min (+5 min/−0 min) before mounting on the test fixture. All testing of the panel shall be completed within 40 min of when the panel is removed from the water.

Conditioned Flexible Vests and Jackets: All flexible vests and jackets that have been subjected to the conditioning protocol described in section 5 shall not be submersed but shall be tested dry.

Hard Armors and Plate Inserts: All hard armors and plate inserts shall be submersed and tested wet. When plate inserts are tested in conjunction with a flexible vest or jacket, the flexible component shall have previously demonstrated its full compliance with this standard at its appropriate level. Both the plate and flexible vest or jacket shall be tested wet.

DETAILED DESCRIPTION

Figure 1:
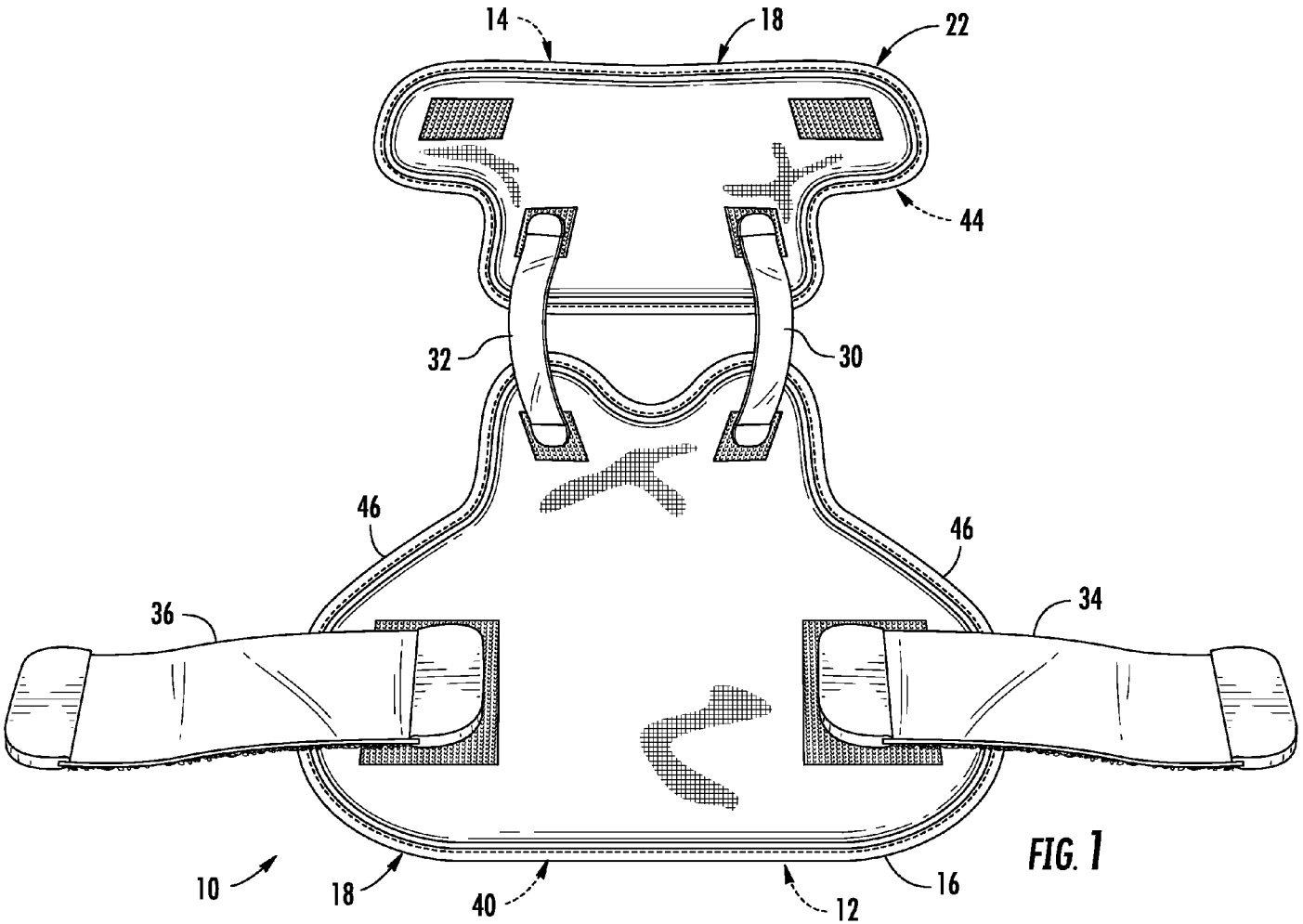
FIG. 1 is a perspective view of the strike side of a vest that is a first embodiment of the invention, the vest being illustrated in a laid flat condition.

The present invention relates to a vest, and in particular to a protective vest including one or more ballistic panels. The invention is applicable to vests of different and varying configurations. As representative of the invention, FIG. 1 illustrates a vest 10 that is a first embodiment of the invention.

The vest 10 includes generally a front ballistic panel 12 and a back ballistic panel 14. The front ballistic panel 12 is enclosed in a front panel cover 16, forming a front panel assembly 18. The back ballistic panel 14 is enclosed in a back panel cover 20, forming a back panel assembly 22.

Figure 3:
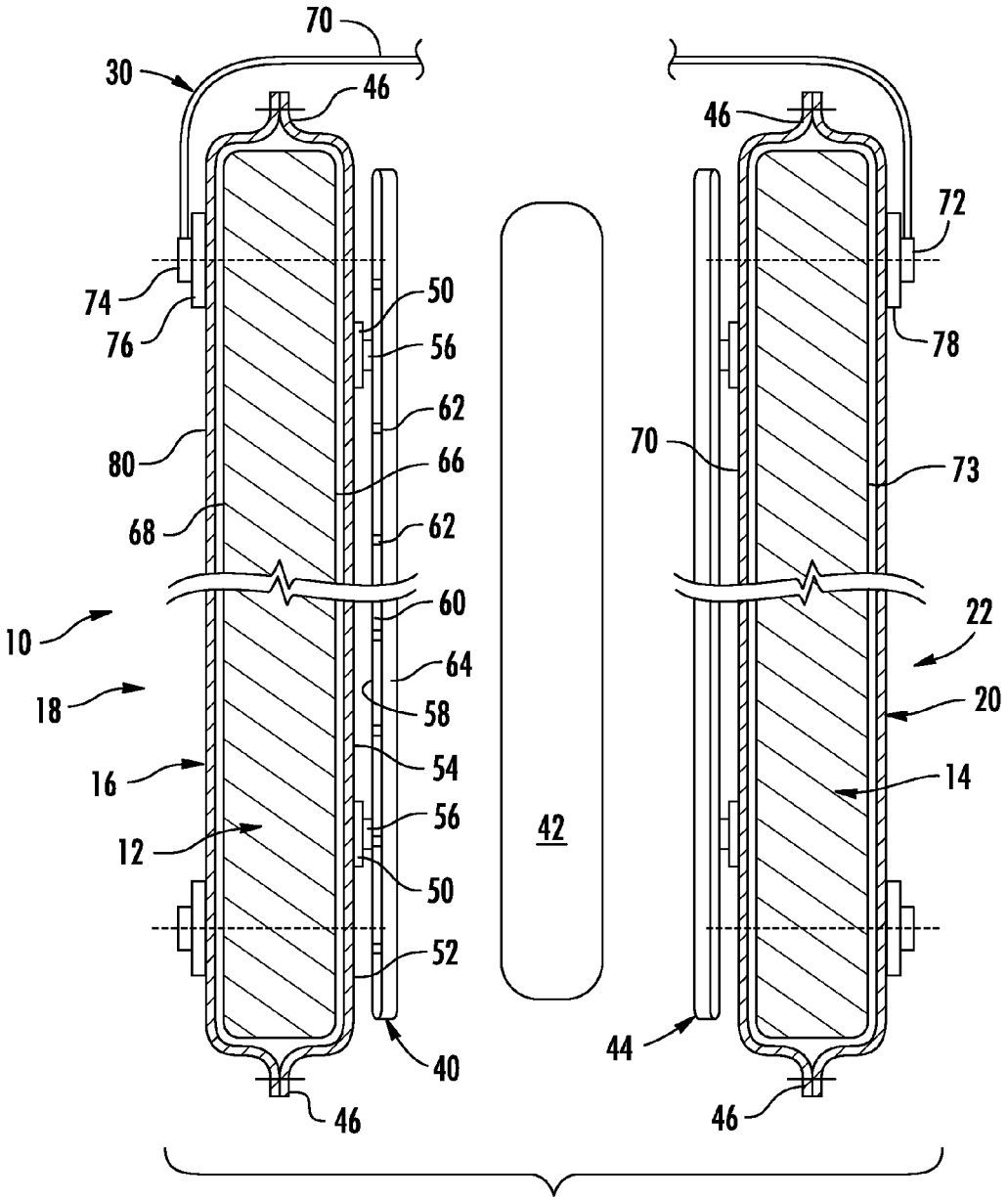
FIG. 3 is a schematic sectional view of the vest of FIG. 1, shown on a wearer.
Figure 4:
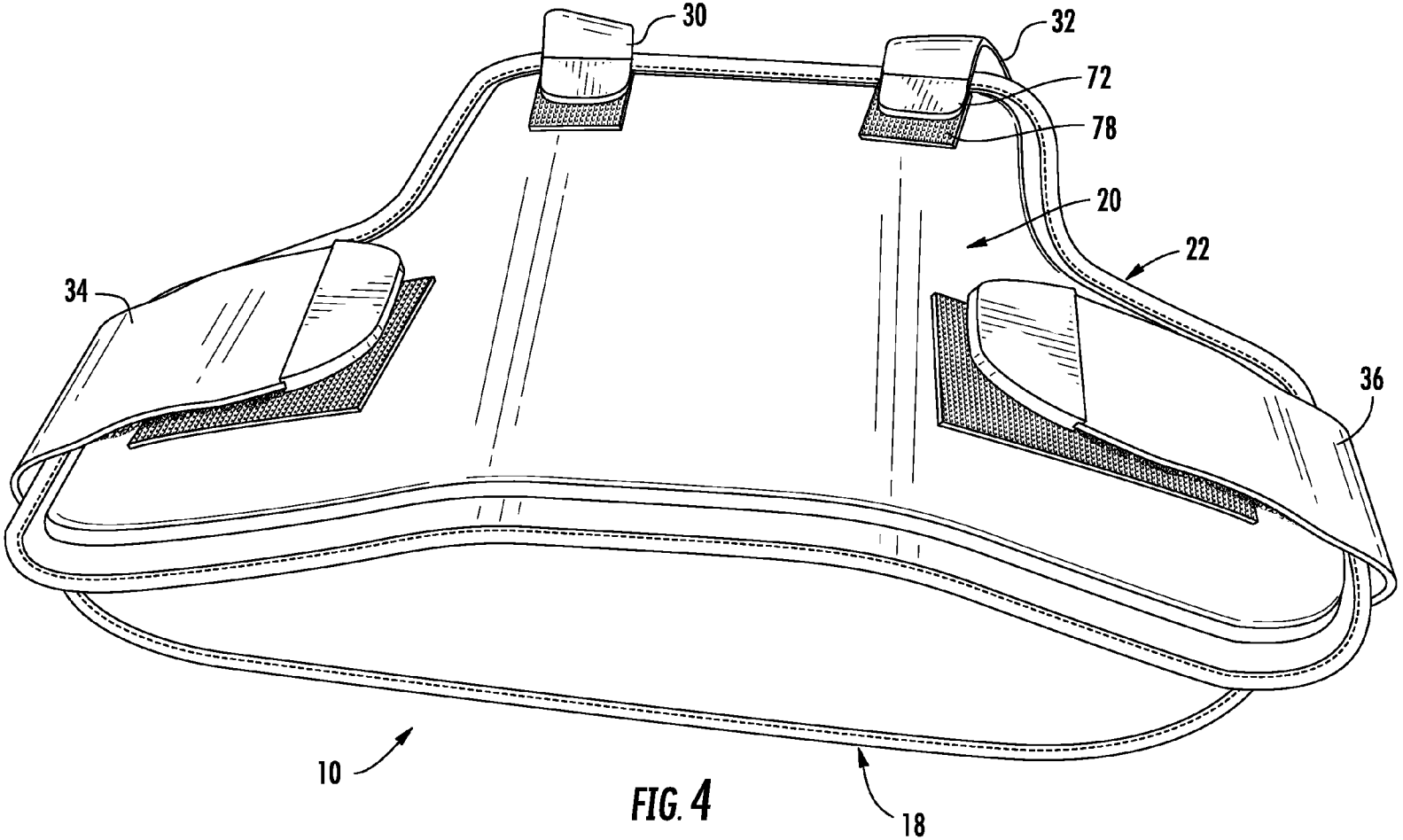
FIG. 4 is a perspective view of the vest of FIG. 1, shown in a closed condition.
Figure 5:
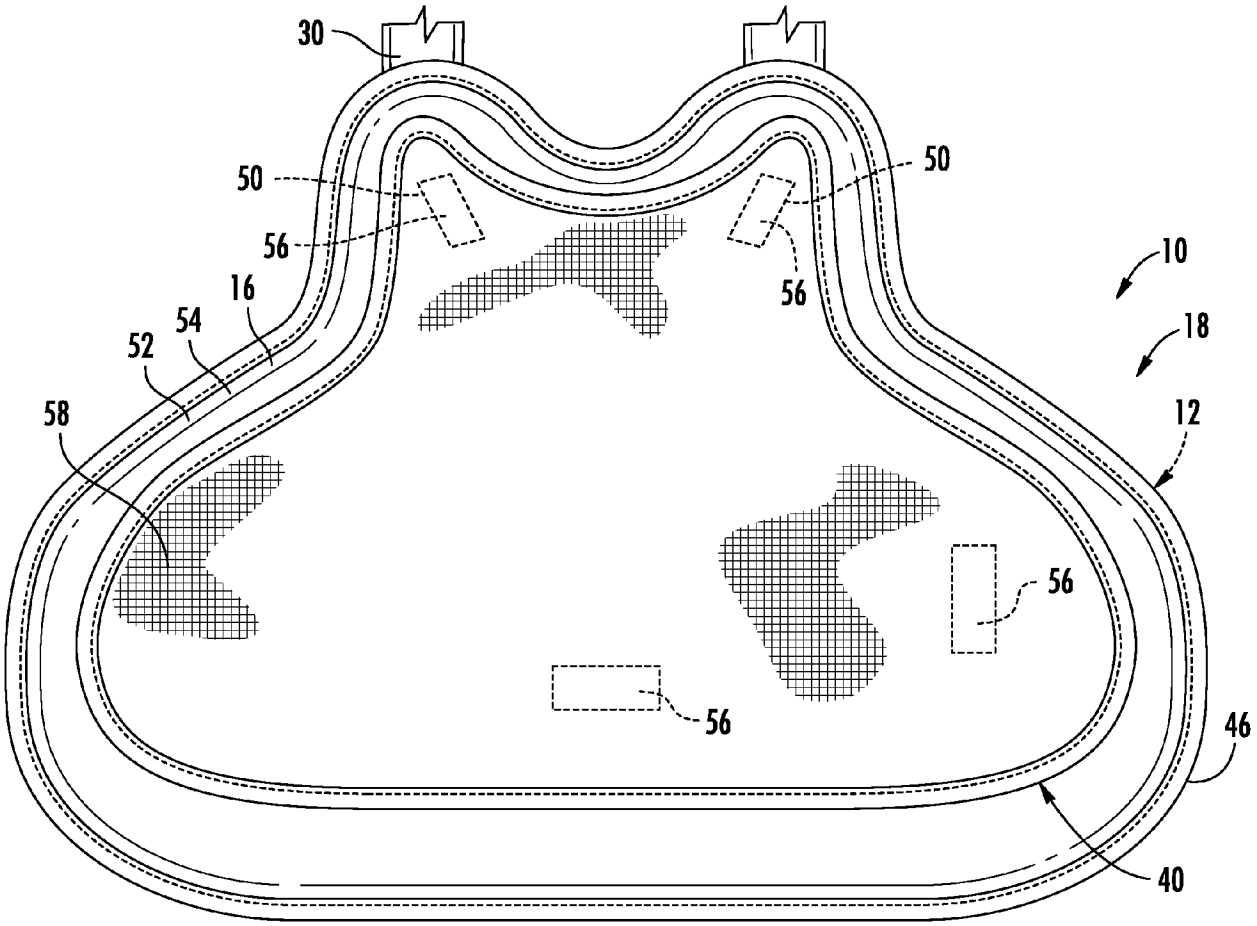
FIG. 5 is a view of the inside of the front panel of the vest of FIG. 1, showing the removable liner.
Figure 6:
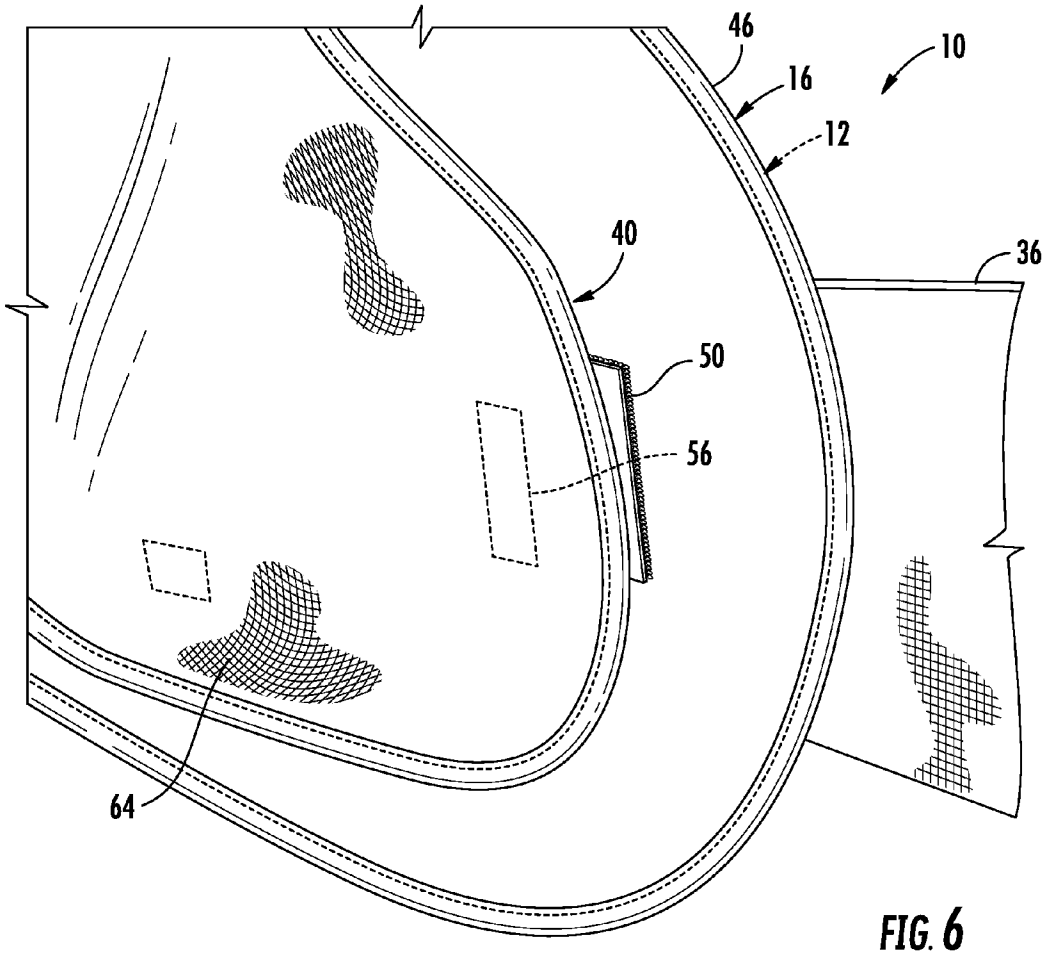
FIG. 6 is a close up view of the front panel of the vest of FIG. 1 including the removable liner.

A left shoulder strap assembly 30 extends between the front panel cover 16 and the back panel cover 20, in a position to extend over the left shoulder of the wearer (the element 42 in FIG. 3 indicates schematically the wearer of the vest 10). A right shoulder strap assembly 32 extends between the front panel cover 16 and the back panel cover 20, in a position to extend over the right shoulder of the wearer 42.

A left waist strap assembly 34 extends between the front panel cover 16 and the back panel cover 20, in a position to extend around the left waist area of the wearer 42. A right waist strap assembly 36 extends between the front panel cover 16 and the back panel cover 20, in a position to extend around the right waist area of the wearer 42.

A front liner 40 is detachably secured to the front panel cover 16, in a position to extend between the front panel 12 and the torso of the wearer 42. A back liner 44 is detachably secured to the back panel cover 20, in a position to extend between the back panel and the torso of the wearer 42.

The front ballistic panel 12 and the back ballistic panel 14 are each made from a ballistic material (or materials) suitable for offering protection to the wearer against projectiles such as bullets. As the construction of the ballistic panels 12 and 14 does not, itself, form part of this invention, the panels will not be described in further detail. For purposes of this invention, however, it is important to note that there are certain operational requirements and standards that are applicable to the panels 12 and 14. One of these relates to water resistance and waterproofing. This requirement is found in the NIJ standard set forth above. In this application, the term 'waterproof' is used to mean that that panel or garment meets this NIJ standard.

The front panel cover 16, as constructed, permanently encloses the front ballistic panel 12. The back panel cover 20 (FIG. 3) is similar if not identical in construction to the front panel cover 16; therefore, only the front panel cover is described in detail herein. Of course, even the most permanent of coverings can be opened upon the total destruction of the cover itself. But the cover 16 is not user openable without destroying its waterproofing capabilities; the front panel is thus, effectively, unremovable.

As examples, the cover 16 may be factory sealed via ultrasonic or RF sealing, and/or by a heat press; any of which are known fabric closure methods, and indicated at the edges of the cover by the reference numeral 46. Or, the cover 16 can be sewn shut. A hook-and-loop connection to close the cover would not be permanent. The cover 16 can be reopened and refurbished at the factory if necessary, but the user (wearer) cannot do this.

The material from which the cover 16 is formed is, itself, waterproof. In addition, the edges of the cover 16 are factory sealed in a waterproof manner, as described above. Desired material characteristics for the cover 16 include durability, abrasion resistance, protection of the enclosed ballistic panel, and waterproofing. Specific materials that can be used as the cover 16 include nylon, polyester, urethane, thermoplastic fabrics and films and combinations of any or all of these. Other materials that can be suitable are Gore-Tex brand fabrics and other permeable fabrics.

The detachable body side or front liner 40 is located between the front panel assembly 18 and the torso of the wearer 42. The back liner 44 (FIG. 3) is similar if not identical in construction to the front liner 42; therefore, only the front liner is described in detail herein.

The detachable body side or front liner 40 is located between the front panel assembly 18 and the torso of the wearer 42. In the illustrated embodiment, the liner 40 is held on to the front panel cover 16 by hook and loop fasteners. A plurality of patches 50 of hook/loop material are affixed to the body side portion 52 of the outer side surface 54 of the front panel cover 16. Corresponding patches 56 of hook/loop material are affixed to the non-body major side surface 58 of the front liner 40. The patches 56 on the liner 40 engage the patches 50 on the cover 16 to removably secure the liner to the cover.

The liner 40 is breathable and is machine washable for sanitary purposes. To this end, the liner 40 is not merely a single thin layer of fabric material, as is the case with the inside layer of a standard carrier. Rather, the liner 40 has a significant loft, or thickness. In one embodiment, the liner 40 is about one-eight inch to one-quarter inch thick, and comprises primarily a foam or cushion type material 60 (FIG. 3) with passages 62 that facilitate air flow through and around the liner. Because of its thickness, the liner 40 spaces the covered panel 12 away from the wearer 42, to promote air flow as desired. The air flow can be either by convection or mechanically induced. In addition, the liner material itself is designed to both absorb perspiration and wick it to atmosphere via its structure, and to be antibacterial and antimicrobial.

The liner 40 may, as in the illustrated embodiment, include on its body side a mesh piece 64 to cover and protect the foam type material. One exemplary material as the foam may be TemperDri UB lining available from Emtex Inc. of Danvers, Mass., with a mesh material being Milco Industries Style 1877 fabric, available from Milco Industries of Bloomsburg, Pa. Alternative materials are usable. In addition, the liner may be configured as an inexpensive disposable item, that the user can wear for a period of time (one week, one month), then discard and replace with a clean new liner.

The front liner 40 is located only on the body side 66 of the front ballistic panel 12. It does not extend over the opposite strike side 68 of the panel 12. Similarly, the back liner 44 is located only on the body side 70 of the back panel 14. It does not extend over the strike side 73 of the back panel 14.

Because the liner 40 is the portion of the vest 10 that is closest to the wearer 42, the liner is the piece that normally absorbs perspiration from the wearer and thus needs to be washed periodically. Because the liner 40 is removable, and washable, that function is easily carried out. The liner 40 is simply detached from the panel cover 16, washed and dried. The liner 40 is machine or hand washable by the wearer, in a home washing machine or by hand, without degradation. It can then be replaced on the vest 10.

The cover 16 (and its enclosed panel 12) thus need not be washed so frequently. Thus, the portions of the vest 10 that provide the ballistic protection are both (a) protected from perspiration in the first place and (b) not washed and therefore not subject to degradation. If necessary, the panel cover 16 can be cleaned by hand with a damp cloth and soap, for example.

The dimensions of the liner 40 are selected so that the liner overlies substantially all of the body side 66 of the panel 12. About one inch of the panel 12 may be left uncovered by the liner 40, around the edges of the panel. As a result, the liner 40 is effective to space the covered panel 12 away from the wearer 42 over all or substantially all of the surface area of the covered panel, and to absorb perspiration from the area where the panel overlies the wearer. As a result, the liner 40 minimizes the transmission of perspiration to the panel cover 16 and thus, minimizes the need to clean the panel cover.

Figure 2:
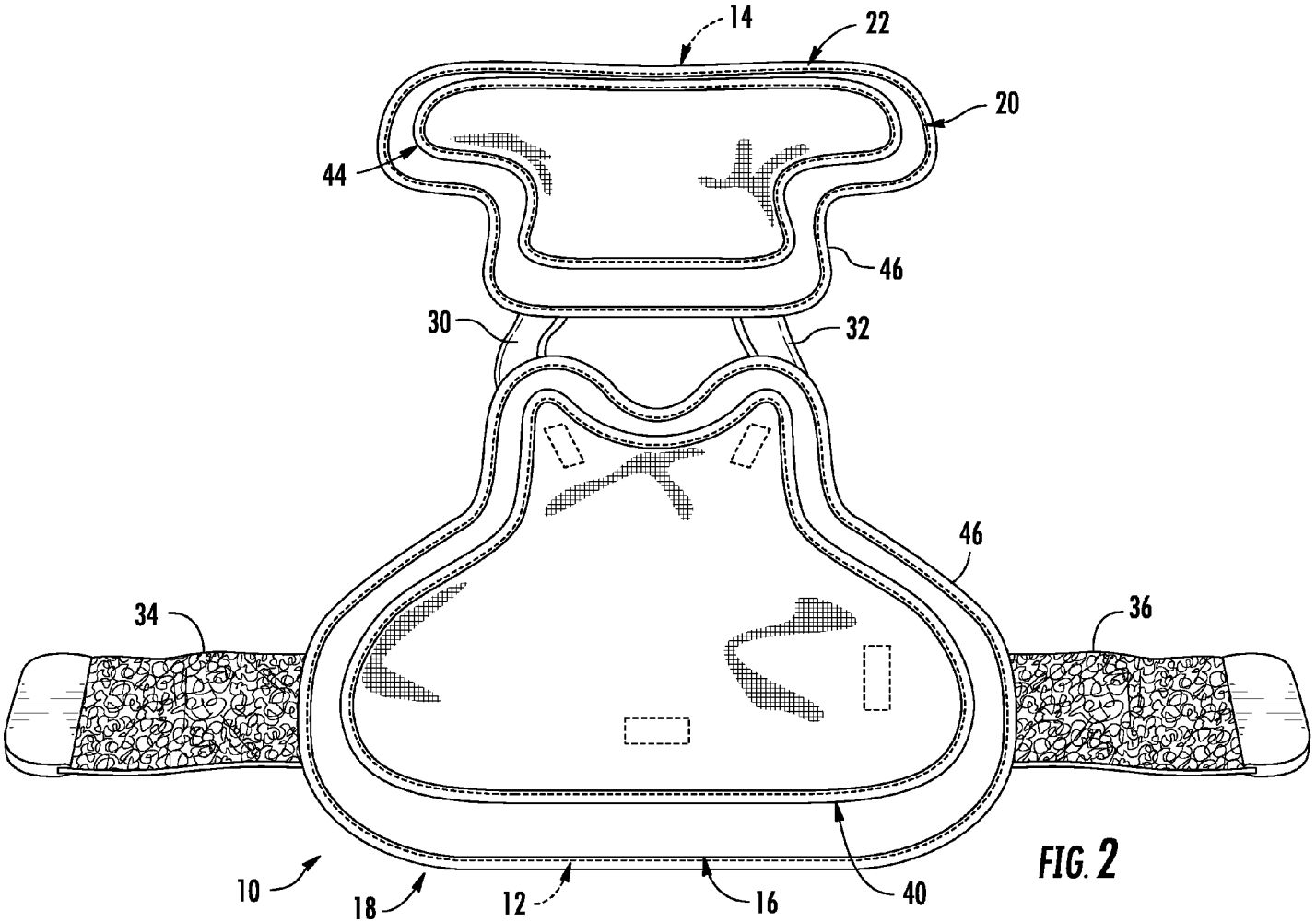
FIG. 2 is a perspective view of the body side of the vest of FIG. 1, the vest being illustrated in a laid flat condition.

The four body securing strap assemblies 30-36 are attached directly to the panel cover 16. As a result, a carrier is not needed for this purpose. The left shoulder strap assembly 30 (FIGS. 1-3) is representative of all four strap assemblies, and so is the only strap assembly described in detail herein.

The left shoulder strap assembly 30 includes, in the illustrated embodiment, five separate elements: the left shoulder strap 70 itself; hook/loop patches 72 and 74 on either end of the strap; and hook/loop patches 76 and 78 on the front and back panel covers 16 and 20, respectively.

To meet the water permeability specifications noted above, it would be difficult or impossible to sew the patches 76 directly to the panel cover 16, without the sewing violating the watertight integrity of the panel cover. Therefore, in the illustrated embodiment, an adhesive is used to attach the patches 76 to the outer side surface 80 of the panel cover 16.

The straps 30-36 are adjustable in length, and for this purpose can be detached from the covers 16 and 20 by opening one or both of the hook and loop connections at the ends, and then resetting in a different position. Other methods of adjustably securing the ends of the straps 30-36 to the covers 16 and 20 can be used, of course.

If a panel is removable from a carrier so that the carrier can be washed, then replacing the panel must be done correctly or much of the panel's protection capability will be sacrificed. This is because a ballistic panel such as the panels 12 and 14 has a designated strike side and a designated body side, and the panel protects much better if it is put on correctly, with the strike side facing out. A significant benefit of the present vest construction is that it eliminates the step of removing a ballistic panel from a carrier. With the present invention, because the panel 12 is not removable from the cover 16, and the cover strike side is readily seen to be different from the cover body side 52, there is next to no chance that the user will assemble and don the garment 10 incorrectly. This is a significant safety feature.

Another benefit of the present vest construction is that the carrier is eliminated altogether. The panel covers 16 and 20 are, in effect, the carrier; there is no separate removable carrier. The covers 16 and 20 serve the function of supporting the strap assemblies 30-36. This makes a simpler product. Thus, the present invention effectively takes what was a three layer product (carrier, panel, carrier) and makes it into a two layer product (panel, liner). All the functionality is preserved, plus the product is thinner to wear, lighter to wear, and error proof as far as assembly is concerned. Using fewer layers of material also provides more comfort to the wearer, and a cooler design.

The invention claimed is:

1. A ballistic vest including:

a front ballistic panel having a strike side and being permanently enclosed in a front waterproof cover, the front waterproof cover having, on its outer surface, portions of an adjustable body-attachment system;

a front body side liner that is detachably secured to a body side portion of the front waterproof cover and that is machine washable;

a back ballistic panel having a strike side and being permanently enclosed in a back waterproof cover, the back waterproof cover having, on its outer surface, portions of an adjustable body-attachment system;

a back body side liner that is detachably secured to a body side portion of the back waterproof cover and that is machine washable; and strap assemblies that releasably connect the front cover and panel with the back cover and panel.

2. A vest as set forth in claim 1 wherein the front liner does not extend over the strike side of the front panel, and the back liner does not extend over the strike side of the back panel;

the front liner has a thickness of about one eighth inch to one quarter inch and is configured with passages to promote air flow either by convection or mechanically induced between the front panel and the torso of the wearer; and each one of the strap assemblies comprises one hook/loop patch adhered to the front panel cover and another hook/loop patch adhered to the back panel cover and a removable strap with hook/loop patches on its ends that extends between the patches.

3. A vest as set forth in claim 2 wherein each panel cover is made from a waterproof fabric material, each panel cover is factory sealed by ultrasonic sealing or radio frequency sealing or sewing or heat press, and each panel cover has elements secured on its outer side surface for enabling connection of body securing waist straps and body securing shoulder straps.

4. A ballistic vest as set forth in claim 1 that does not include or require a carrier.

5. A ballistic vest that is waterproof, including:

a non-waterproof front ballistic panel having a strike side and a body side;

a waterproof front panel cover permanently enclosing the front ballistic panel, the front panel cover having an inner major side surface presented toward the front ballistic panel and an exposed outer major side surface;

a non-waterproof back ballistic panel having a strike side and a body side;

a waterproof back panel cover permanently enclosing the back ballistic panel, the back panel cover having an inner major side surface presented toward the back ballistic panel and an exposed outer major side surface;

a left shoulder strap assembly that is attached to the outer major side surface of the front panel cover and that is attached to the outer major side surface of the back panel cover, in a position to extend over the left shoulder of the wearer;

a right shoulder strap assembly that is attached to the outer major side surface of the front panel cover and that is attached to the outer major side surface of the back panel cover, in a position to extend over the right shoulder of the wearer;

a left waist strap assembly that is attached to the outer major side surface of the front panel cover and that is attached to the outer major side surface of the back panel cover, in a position to extend around the left waist area of the wearer; and a right waist strap assembly that is attached to the outer major side surface of the front panel cover and that is attached to the outer major side surface of the back panel cover, in a position to extend around the right waist area of the wearer.

6. A ballistic vest that is waterproof, including:

a non-waterproof front ballistic panel having a strike side and a body side;

a waterproof front panel cover permanently enclosing the front ballistic panel, the front panel cover having an inner major side surface presented toward the front ballistic panel and an exposed outer major side surface;

a non-waterproof back ballistic panel having a strike side and a body side;

a waterproof back panel cover permanently enclosing the back ballistic panel, the back panel cover having an inner major side surface presented toward the back ballistic panel and an exposed outer major side surface;

a left shoulder strap assembly that is attached to the outer major side surface of the front panel cover and that is attached to the outer major side surface of the back panel cover, in a position to extend over the left shoulder of the wearer;

a right shoulder strap assembly that is attached to the outer major side surface of the front panel cover and that is attached to the outer major side surface of the back panel cover, in a position to extend over the right shoulder of the wearer;

a left waist strap assembly that is attached to the outer major side surface of the front panel cover and that is attached to the outer major side surface of the back panel cover, in a position to extend around the left waist area of the wearer;

a right waist strap assembly that is attached to the outer major side surface of the front panel cover and that is attached to the outer major side surface of the back panel cover, in a position to extend around the right waist area of the wearer;

a washable front liner detachably secured to a body side portion of the front panel cover, in a position to extend between the front panel and the torso of the wearer; and a washable back liner detachably secured to a body side portion of the back panel cover, in a position to extend between the back panel and the torso of the wearer.

7. A vest as set forth in claim 6 wherein the front liner does not extend over the strike side of the front panel, and the back liner does not extend over the strike side of the back panel;

the front liner has a thickness of about one eighth inch to one quarter inch and is configured with passages to promote air flow either by convection or mechanically induced between the front panel and the torso of the wearer; and each one of the strap assemblies comprises one hook/loop patch adhered to the front panel cover and another hook/loop patch adhered to the back panel cover, and a removable strap with hook/loop patches on its ends that extends between them.

8. A vest as set forth in claim 7 wherein each panel cover is made from a waterproof fabric material, each panel cover is factory sealed by ultrasonic sealing or radio frequency sealing or sewing or heat press, and each panel cover has elements secured on its outer side surface for enabling connection of body securing waist straps and body securing shoulder straps.

9. A ballistic vest as set forth in claim 6 that does not include or require a carrier.

* * * * *